United States Patent [19]

Terajima et al.

[11] 4,084,807

[45] Apr. 18, 1978

[54] PAPER FEEDING ROLLER

[75] Inventors: Yasuhiko Terajima; Osamu Matsumoto, both of Ebina, Japan

[73] Assignee: Rank Xerox, Ltd., London, England

[21] Appl. No.: 684,203

[22] Filed: May 7, 1976

[30] Foreign Application Priority Data

Sep. 12, 1975 Japan ..... 50-124930[U]

[51] Int. Cl.[2] ..... B65H 3/06

[52] U.S. Cl. ..... 271/119; 271/118

[58] Field of Search ..... 271/109, 114, 115, 117, 271/118, 119, 120, 139, 140; 221/259, 260

[56] References Cited

U.S. PATENT DOCUMENTS

| | | | |
|---|---|---|---|
| 1,394,613 | 10/1921 | Drury | 271/119 |
| 3,649,003 | 3/1972 | Schinke | 271/120 |
| 3,664,661 | 5/1972 | Weeks et al. | 271/114 |
| 3,968,959 | 7/1976 | Johnson et al. | 271/140 |

FOREIGN PATENT DOCUMENTS

| | | | |
|---|---|---|---|
| 2,300,870 | 7/1973 | Germany | 271/119 |

*Primary Examiner*—Robert W. Saifer

*Attorney, Agent, or Firm*—James J. Ralabate; Clarence A. Green; William A. Henry, II

[57] ABSTRACT

A sheet-feed roller system that employs an annular deformable resilient roller eccentrically mounted on a shaft for rotation whereby rotation of the shaft brings the roller into contact with sheets only when they are to be fed by the roller in order to increase the feed force while minimizing the pressing force on the sheets to thereby reduce sheet misfeed.

1 Claim, 4 Drawing Figures

PAPER FEEDING ROLLER

BACKGROUND OF THE INVENTION

This invention relates to a sheet feeding apparatus and more particularly to a paper feeding roller for feeding sheets of paper such as copy sheets or print-out sheets to a body in copiers or printing presses.

In conventional copiers, printing presses or the like, sheets of paper pre-cut into a given size are utilized as a final support such as copy sheets or print-out sheets, a paper-feeding roller is used to feed the sheets, sheet by sheet into the copier. Most paper-feed rollers of this kind utilize a frictional force generated in the peripheral surface of the rollers, but in a case where sheets come into intimate contact with one another, a piled-feed occurs in which a plurality of sheets are simultaneously fed. With W representing the pressure at which the paper-feed roller is pressed against a sheet, the aforementioned piled-feed will occur as a result of the fact that sheets of paper are brought into intimate contact with one another and the coefficient of friction in static frictional force F increases to provide the relationship of $f > F$ between the feed force $f$ by the paper-feed roller and the static frictional force F.

Conversely, if the static frictional force F is greater than the feed force $f$, misfeed occurs and no sheet can be fed at all.

From the above, it is advisable to minimize the pressure force W of the paper-feed roller while increasing the feed force in order to carry out paper-feeding without occurrence of both piled feed and misfeed; however, in the paper-feed roller system it is impossible to not use the pressing force W at all, and therefore, in an ideal paper-feeding means the pressing force W is applied to the sheet only when necessary, and at the same time, speed of paper feed is increased to enhance the feed force $f$.

Accordingly, it is an object of this invention to provide a feed-roller system that increases the feed force while minimizing the pressing force on sheets to be fed by the feed-roller system.

Another object of the invention is to reduce the piled feed and misfeed of sheets due to an excessive pressing force.

Yet another object of this invention, is to increase the contact area of the paper-feed roller with sheets to be fed while simultaneously decreasing the pressure force on the sheets.

SUMMARY OF THE INVENTION

In a sheet feeding apparatus including a shaft having an axis of rotation with the shaft being adapted for eccentrically mounting a sheet-feeding roller thereon with the roller having an axis of rotation, the improvement is disclosed comprising a boss on the shaft with fastening means for mounting the sheet-feeding roller to the boss eccentrically on the axis of rotation of the shaft. The sheet feeding roller comprises an annular open resilient band-like member and the axis of rotation of the shaft is adjacent one side of the resilient member.

BRIEF DESCRIPTION OF THE DRAWINGS

For a better understanding of the invention as well as other objects and further features thereof, reference is had to the following detailed description of the invention to be used in conjunction with the accompanying drawings, wherein.

DESCRIPTION OF THE PREFERRED EMBODIMENT

Various attempts have been made to solve the problem of piled-feed and misfeeding of sheets including U.S. Pat. Nos. 664,340; 694,039 and 3,485,489. In view of the fact that piled-sheet feeding and misfeeding still occurs, the present invention is presented wherein a paper-feeding roller is provided in which the roller body comprises an annular open resilient band-like member. The roller is brought into contact with a sheet of paper only when the latter is fed in order to relieve the pressing force applied to the sheet in addition to increasing the contact area or surface touching the sheet as well as the feed force, to thereby prevent piled-feed and misfeed when sheets are fed.

Figure 1:
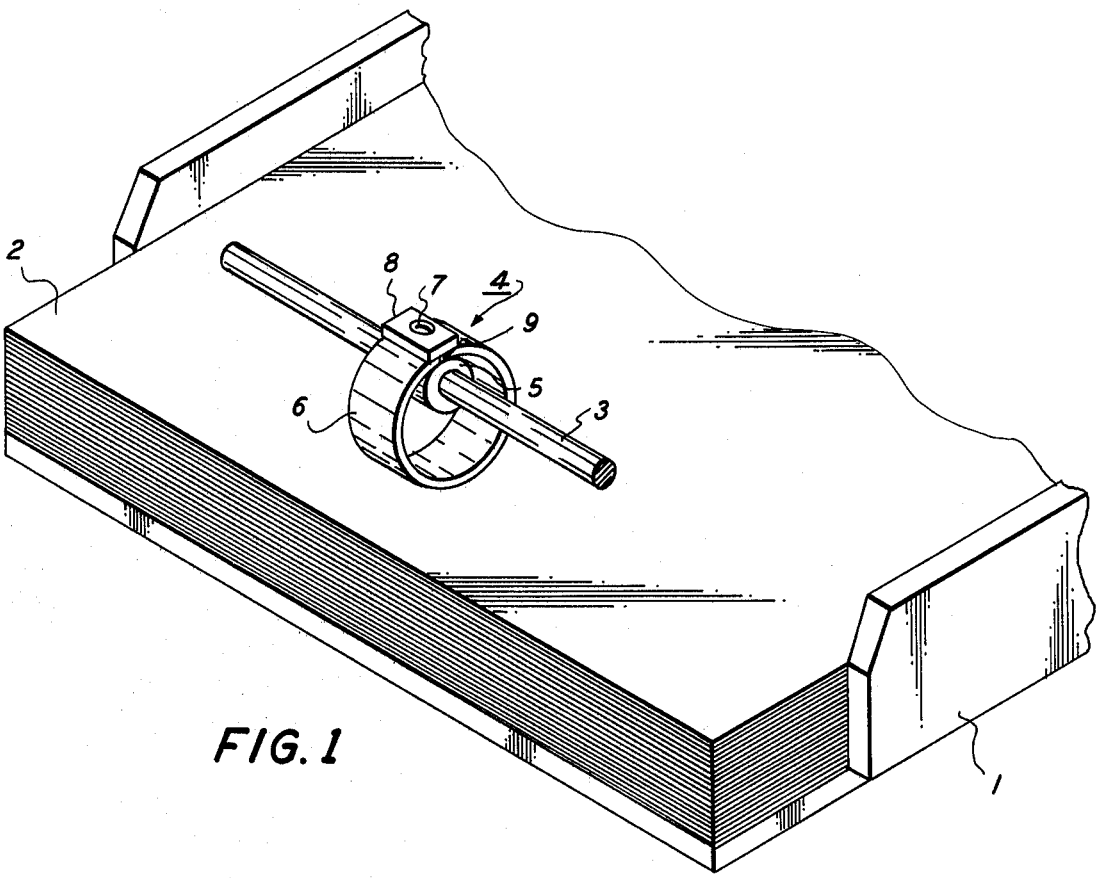
FIG. 1 is an overall perspective view of the invention.

This invention will now be described in detail by way of the embodiments shown in the drawings. In FIG. 1, numeral 1 indicates a tray for the accommodation of sheets of paper or other substrates 2 to be fed to a copier or a printing press or the like the sheets of paper being placed in a pile within tray 1. Above the sheets 2 there is provided a rotary shaft 3 having an axis of rotation fixed centrally thereof which is rotated in interlocking relationship with a drive mechanism (not shown) since any conventional drive system can be used.

Fixedly mounted on the rotary shaft 3 is a boss portion 5 and a roller body 4, a peripheral surface portion of which is formed with a partially cut-out plane portion 9, to which the opposite ends of an interrupted or discontinuous deformable band-like strip 6 arranged to gently surround the circumference of the boss portion 5 are held by keeper plate 8 fastened by fastening means 7. The above-mentioned band-like body 6 having an axis of rotation is formed of a soft resilient deformable body in open annular configuration, with its opposite ends being fastened adjacent the axis of rotation of the shaft 3 to one side of the peripheral surface portion of the boss portion 5 so as to have an annular structure eccentric to the center of the boss portion 5 and the rotary shaft 3.

Figure 2:
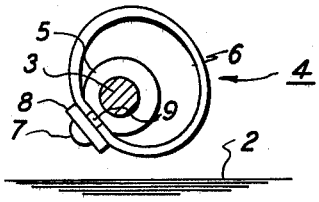
FIG. 2 is a side view of the paper-feed roller of the present invention in a non-contact position.
Figure 3:
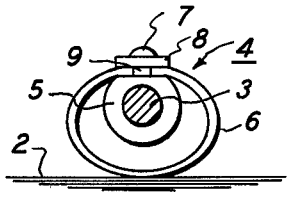
FIG. 3 is a side view of the paper-feed roller of the present invention in a contact or paper-feed position.

In feeding sheets of paper, when the rotary shaft 3 is rotated, the roller body 4 fastened to the rotary shaft 3 is rotated from a position shown in FIG. 2 to the position shown in FIG. 3, and the annular band-like member 6 comes into contact with the upper surface of the sheet 2 to feed the uppermost sheet 2 in the rotating direction of the roller body 4. When the sheet has been fed, the paper-feeding roller 4 again assumes the position shown in FIG. 2, thus not applying unnecessary pressing force W to the sheet 2. That is, the pressing force W is applied only when the sheet is fed and at the same time the deformable interrupted band-like member 6 flattens or comes widely into contact or engagement with the sheet 2 to thereby increase the feed force, as a consequence of which the piled-feed or misfeed is substantially prevented.

Figure 4:
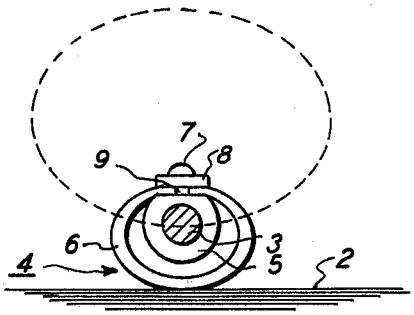
FIG. 4 is a side view of an alternative embodiment of the present invention showing the locus of the rotary shaft of the paper-feed roller.

FIG. 4 illustrates another embodiment of the present invention in which rotary shaft 3, which supports the sheet feeding roller 4 is elliptically revolved along a locus as indicated by the dashed line. The axis of rotation of the shaft 3 is within the locus. In this way, paper feeding without occurrence of piled-feed or misfeed may also be accomplished even by driving the roller body 4.

In conclusion, the present invention provides an arrangement wherein an open annular interrupted resilient band-like body is mounted eccentric to a boss portion whereby the band-like body increases in surface area as it is rotated into contact with a sheet with rotation only occurring when a sheet is to be fed, and as a result, no pressure is applied to the sheet at any time other than for feeding paper to thereby eliminate a possible pile-feed due to the imminent contact of sheets caused by unnecessary pressure. This arrangement also discloses the idea of increasing the contact area between the sheet and the roller body to thereby increase the feed force, and from this, prevent a possible occurrence of misfeed.

In addition to the apparatus outlined above, many modifications and/or additions to this invention will be readily apparent to those skilled in the art upon reading this disclosure and these are intended to be encompassed within the invention disclosed and claimed herein.

What is claimed is:

1. An apparatus for feeding substrates comprising in combination:

a rotatable shaft;

an elliptical interrupted, resilient member connected to said shaft so that it rotates with said shaft; and wherein said elliptical interrupted resilient member is mounted eccentrically to said shaft so that as the shaft rotates said annular resilient member flattens on said substrates to feed said substrates.

* * * * *